US005335999A

United States Patent [19]

Farb et al.

[11] Patent Number: 5,335,999

[45] Date of Patent: Aug. 9, 1994

[54] PRINTER HAMMERSPRING

[75] Inventors: Norman E. Farb, Villa Park; James Y. Chon, Pomona, both of Calif.

[73] Assignee: Printronix, Inc., Irvine, Calif.

[21] Appl. No.: 987,377

[22] Filed: Dec. 8, 1992

[51] Int. Cl.[5] ..... B41J 2/245

[52] U.S. Cl. ..... 400/124.21; 400/124.23; 101/93.04; 101/93.48

[58] Field of Search ..... 400/121, 124, 157.2; 101/93.04, 93.05, 93.29, 93.48

[56] References Cited

U.S. PATENT DOCUMENTS 4,233,894 11/1980 Barrus et al. ..... 101/93.04
4,423,675 1/1984 Luo et al. ..... 101/93.04
4,461,207 7/1984 Helinkski ..... 101/93.04
4,610,553 9/1986 Yasunaga et al. ..... 400/124
4,777,875 10/1988 Fujiwara et al. ..... 101/93.04
4,790,674 12/1988 Kleist et al. ..... 101/93.04

*Primary Examiner*—Edgard S. Burr
*Assistant Examiner*—John S. Hilten
*Attorney, Agent, or Firm*—George F. Bethel; Patience K. Bethel

[57] ABSTRACT

The specification sets forth a hammerspring for a dot matrix printer having a plurality of such hammersprings spaced along a hammerbank with permanent magnetics to draw said hammersprings into a retracted and uniformly stressed mode through a spring portion which are released by overcoming the magnetic retention, the hammerspring formed with a base portion connected to the hammerbank with a spring portion extending from said base portion having a decreasing transverse cross sectional area extending to an enlarged end portion for improved magnetic retention against said permanent magnets.

24 Claims, 4 Drawing Sheets

PRINTER HAMMERSPRING

BACKGROUND OF THE INVENTION

It is common to use mechanical dot matrix printers for high speed applications. Generally, the dot matrix printers utilize a hammerspring with a tip at the end thereof to impact a ribbon. The ribbon impaction is then received as a printed dot on paper that is to be printed upon and is supported by a platen.

The series of dots printed on the paper provide letters, numbers, and other symbols on the paper. A very common use today of dot matrix printers is the printing of bar codes.

Bar codes are becoming prevalently used in a greater number than ever before. During the printing of such bar codes, it is common to use impact printing mechanisms consisting of a hammerspring to achieve the printed dots that conform to the bar code that is to be printed. This is particularly true with respect to dot matrix printers that are known as line printers.

Prior art hammerspring designs are generally of a configuration having a uniform thickness and width throughout the spring. This physical configuration is in the nature of a leaf spring.

Such leaf springs do not provide the capability of storing energy in an efficient and effective manner as the invention hereof. When storing the energy for release of the hammerspring, a higher energy storage provides for a better printing force, a faster cycle time and more importantly, significant life. The leaf spring hammerspring designs of the prior art did not achieve the cycle times of this invention in combination with the life and force of impact as is provided by the hammerspring of this invention.

There are various regions of concern in the action of a hammerspring for a dot matrix printer and in particular a line printer. These regions are in association with a series of hammerbank permanent magnets that hold the hammersprings in a retracted position under a magnetic force. When the magnetic force is released by electrical coils, the hammersprings are able to fire into a ribbon with the print tips or pins in order to effectuate a printing through the ribbon onto the paper.

A fundamental design constraint is the force that can be utilized through the poles of the permanent magnets in order to hold the hammersprings. This is critical with regard to the air gaps and the nature of the material being used for the hammerspring.

A criteria as to the aspects of retaining the hammersprings is such as to allow a maximum rate of firing to meet a specified number of lines per minute of the printer. The force requirement for retaining the hammersprings by overcoming their elastic nature must be in balance with the hammerspring material. The hammersprings must not only provide for suitable mechanical properties, but also magnetic properties and magnetic retention through mechanical design, shape, and metallurgical requirements.

The invention hereof provides for magnetic retention, through a design which has a sufficient cross section and mass to obtain a required magnetic force for retaining the hammerspring. On the other hand, in order to maintain rapid firing, it is necessary to minimize the mass of the hammerspring. In effect, it is necessary to produce maximum force with a hammerspring with minimum mass.

The inventors hereof have been able to achieve this by having a large cross sectional area in the magnetic field between the pole pins of the permanent magnets to support the flux therein. The magnetically conductive circuit is optimized to allow for a substantial amount of magnetic flux to flow while at the same time minimizing the mass of the hammerspring.

Another important concern is in the hammerspring spring region which provides the stored energy. The spring region should be such that it will provide substantially infinite life over the life of the printer. It must also have an excellent dynamic response and adequate frequency response.

The prior art leaf type hammersprings do not provide for these effects in the most efficacious manner. This invention overcomes the prior art deficiencies by allowing the width and the thickness of the hammersprings to be gradually reduced along the length of the hammerspring portion. This results in a uniform stress, along the active spring storage portion of the hammerspring rather than a peak of stress at the maximum bending moment position.

Finally, the area where the hammerspring is to be clamped has to be designed such that any one hammerspring is isolated from the other hammersprings. Any one hammerspring's behavior should not influence or be influenced by a neighboring hammerspring. Furthermore, once the hammersprings have been emplaced, they should not have to be reset and should have constant characteristics.

The inventors have done this by providing for uniform hammersprings on a fret. These frets are preestablished and can be moved from one location to the other on a hammerbank without re-calibrating them. In effect, the inventors have been able to provide for a uniform hammerspring action once the hammersprings have been manufactured and emplaced.

The invention hereof is a significant step over the art with respect to hammersprings in their configuration and operation. The net result is to provide for a hammerspring and printer with a hammerbank which significantly improves the operation and life over that of the prior art.

SUMMARY OF THE INVENTION

In summation, this invention comprises a hammerspring and hammerbank system for a dot matrix printer which enhances the stored energy in the hammerspring by converting the stored magnetic potential energy to mechanical energy and allowing for a release of the stored mechanical energy on an optimized basis.

More specifically, the hammerspring is formed as an enhanced integral component of the permanent magnetic circuit. When the hammerspring is placed in the hammerbank, the ends of the hammerspring form a lower reluctance path to the magnetic circuit which serves to increase the magnetic field through the circuit. This results in stored magnetic energy in the two air gaps between the hammerspring and the two pole pins. The effect is an increased amount of energy to pull the hammerspring toward the pole pins.

In order to provide for a significant amount magnetic force at the pole pins, a large flux path is created through the end of the hammerspring. This large flux path allowing for greater magnetic force is opposed by the mechanical forces in the hammerspring. The net result is to provide for stored energy in the hammerspring in the form of the stress that is imposed when the hammerspring is retained by the magnetic force at the pole pins.

The stored mechanical energy arises due to mechanical stress in a cross section of the hammerspring that is designed to be less than the maximum stress allowed by the fatigue strength of the particular magnetic steel used. In order to optimize this, the hammerspring mechanical spring area is designed to decrease in cross section from its mounting point so that uniform stress can be provided along the length of the hammerspring mechanical spring portion. This reduction of thickness and width from the clamping area reduces the transverse or lateral cross section of the hammerspring. This provides for uniform stress levels in the hammerspring.

Finally, the hammerspring is supported in a clamping region. The clamping region is designed such that it is of significant mass and isolates the hammerspring so that it can operate in a stressed mode without affecting any neighboring hammersprings or providing vibrational modes that are not desirable. This is further enhanced by the hammersprings being formed on a fret of a plurality or multiplicity of hammersprings for movement and placement as a plurality thereof on the hammerbank.

The essence of this invention as seen in the summary and the background of the invention will now be seen in greater detail in the following specification.

DETAILED DESCRIPTION OF THE SPECIFICATION

Figure 1:
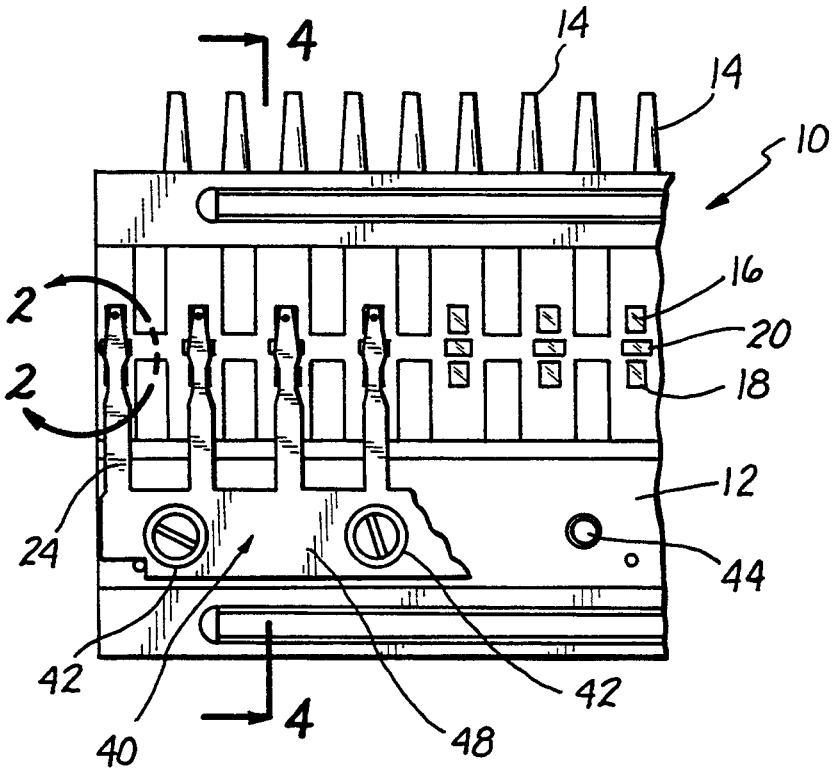
FIG. 1 shows a fragmented front elevation view of a hammerbank of this invention with the hammersprings thereof.

Looking particularly at FIGS. 1, 2, 3, and 4 it can be seen that a printer hammerbank 10 has been shown. The printer hammerbank 10 incorporates a framework 12. The framework 12 is formed from a metal casting. The metal casting can be machined or formed in any suitable way so as to provide for the magnetic and support functions for the operation of the hammersprings placed along the hammerbank 10.

In conjunction with the framework 12 a series of fins 14 are provided. Fins 14 provide heat dissipation as a respective heat sink enhancing operation.

The framework 12 is such wherein it has been machined, milled, or configured in any suitable manner so as to provide a number of through holes. These through holes can be seen as openings 15 in FIG. 4. The through holes 15 provide for the emplacement of the magnets with the pole pieces. The configuration of the magnets and their function will be detailed hereinafter.

The pole pieces that conduct the permanent magnetism are seen as magnetic poles or pole pieces 16 and 18. The magnetic poles or pole pieces 16 and 18 are divided by a magnetic insulator and contacting wear bar 20 made of inconel steel.

Each pole piece 16 and 18 is placed in alignment within the framework 12 so as to provide for a plurality of pairs of pole pieces 16 and 18. These pairs of pole pieces 16 and 18 magnetically retain and then release a number of hammersprings 24.

The hammersprings 24 and their configuration which is the heart of this invention can be seen in greater detail in many of the remaining figures which shall be amplified upon.

The pole pieces 16 and 18 are formed of a magnetic alloy so that magnetism can be established by them at the tips of the pole pieces 16 and 18. This magnetism at the tips of the pole pieces 16 and 18 is such wherein it holds the hammersprings 24 in close but not necessarily contacting juxtaposition to the pole pieces against the wear bar 20 until they are released by electrical flow through coils overcoming the permanent magnetic forces. These electrical coils shall be detailed in conjunction with the overall magnetic and pole piece 16 and 18 functions hereinafter.

Figure 3:
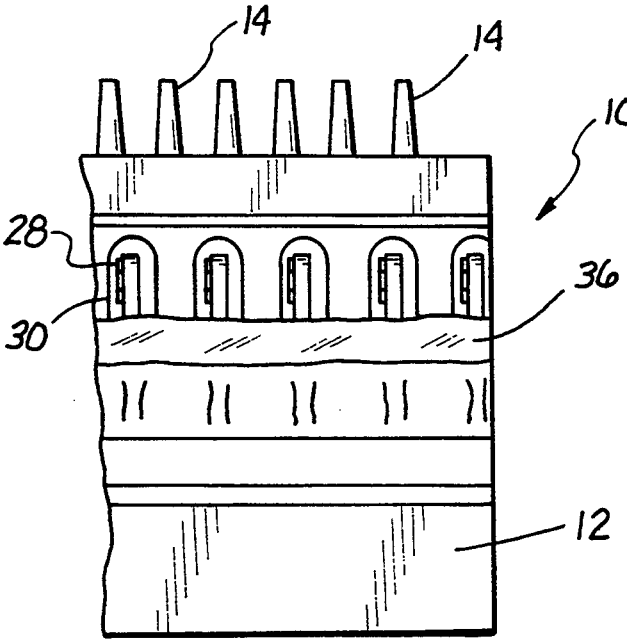
FIG. 3 shows a rear elevation view of the hammerbank of this invention displaying the terminals thereof for causing the hammersprings to fire.

The release of the hammersprings 24 by means of the electrical windings overcomes the permanent magnetism at the pole pieces 16 and 18. Such release can be by any electrical force placed in juxtaposition to the pole pieces to nullify their permanent magnetism for a brief instant. This is accomplished by connection to a current or voltage source provided at terminals 28 and 30. The terminals 28 and 30 are in the rear of the framework as seen in FIG. 3. These terminals 28 and 30 are connected to a power source sufficient to provide for the coils or other electrical force wrapped around the permanent magnet pole pieces 16 and 18 to overcome the magnetic force of the permanent magnet thereby releasing the hammersprings 24.

In order to bleed off transients and overcome any electrical noise a ground strip 36 is emplaced within the rear of the hammerbank as shown in FIG. 3 across the magnetics. This ground strip allows for any transients to be bled so that untimely transients will not change the quick firing mechanisms provided by the electrical input at the terminals 28 and 30 to avoid untimely releasing of the hammersprings 24.

The hammersprings 24 are formed in frets having a plurality of hammersprings which can be seven (7) in number. This can be seen specifically in FIG. 1. One of these frets is shown as fragmented fret 40 having four (4) hammersprings 24 connected to the framework. This fret is secured to the framework 12 by means of screws 42. These screws 42 secure the fret 40 to the framework 12 by being threaded into tapped openings 44 of the framework 12. Thus a plurality of frets 40 can be threaded to the framework 12 along the base thereof. This allows for a plurality of hammersprings 24 to be secured and released with respect to the magnetic action of the pole pieces 16 and 18.

Figure 4:
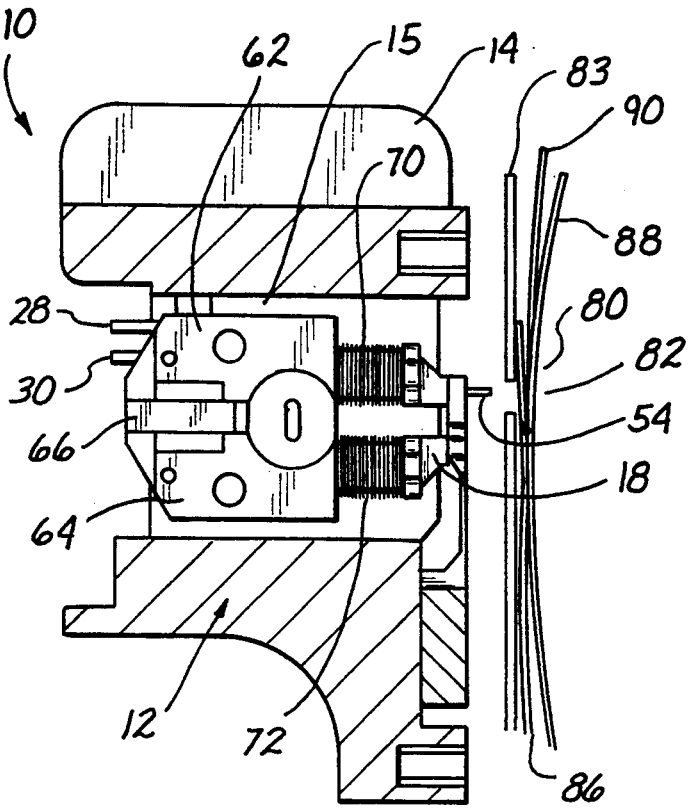
FIG. 4 shows a sectional view through the hammerbank of FIG. 1 in the direction of lines 4—4 thereof.

The frets 40 with the hammersprings 24 are initially milled from a single piece of spring steel. As seen in FIG. 4, in the side elevation view of the hammerspring 24 and fret 40, a plurality of hammersprings 24 have been milled with their base 48 forming the frets 40. Often times, it is preferable to grind the frets 40 in order to provide for a smoother, less strain lined surface to the hammersprings 24.

Figure 5:
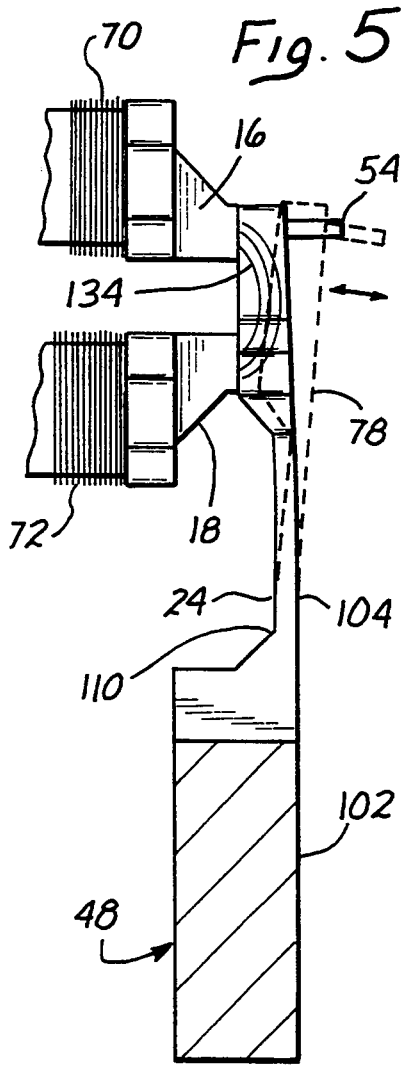
FIG. 5 shows a detailed view of the hammerspring shown in FIG. 4 with the hammerspring in a retracted position and a dotted overlay after it has been released or fired.
Figure 6:
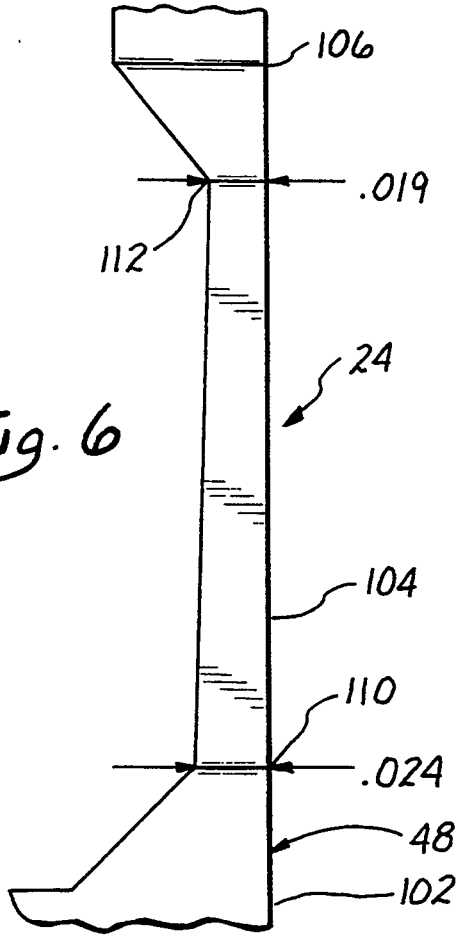
FIG. 6 shows a fragmented detailed view of the neck or spring portion of the hammerspring.
Figure 7:
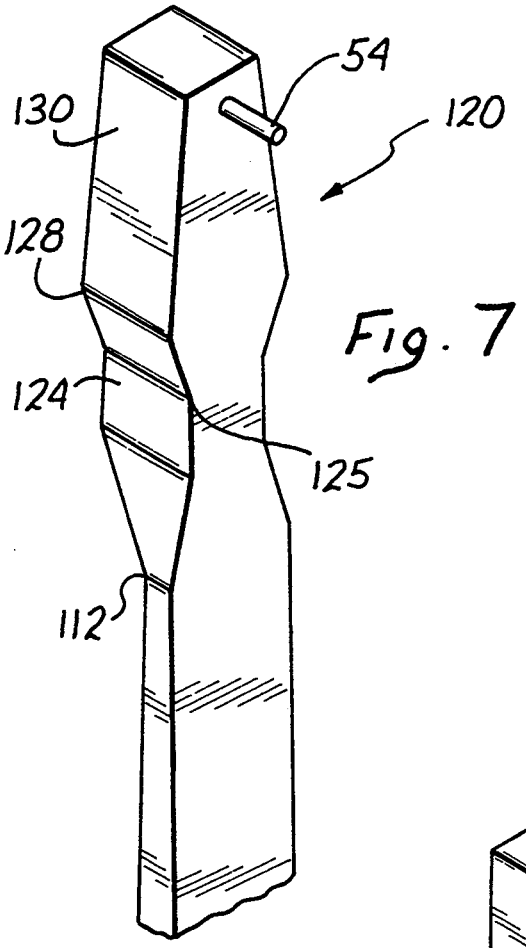
FIG. 7 shows a fragmented perspective view of the front of the hammerspring as seen from the frontal portion thereof of FIG. 2.
Figure 8:
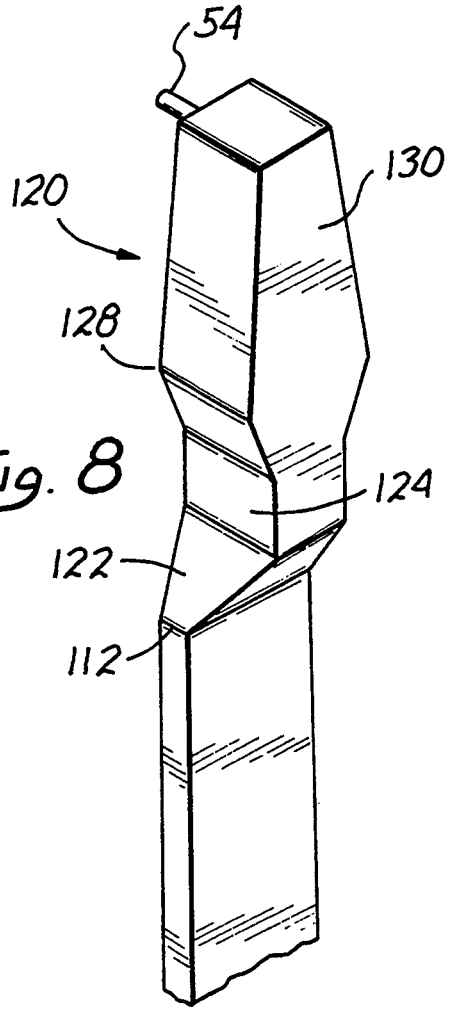
FIG. 8 shows a rear fragmented perspective view of the hammerspring of this invention.

In essence, the sectional view or dimensions of the side or thickness as seen in FIGS. 4, 5, and 6 of the hammersprings 24 is provided by grinding a fret 40 to provide for the cross sectional shape or dimension or thickness. Thus, a piece of stock initially starting out as stock having a given thickness generally of the base 48 is ground to the side or cross sectional dimension of the thickness. This provides for the orientation of a very finely dimensionally configured hammerspring 24 in the cross sectional direction of FIGS. 4, 5, and 6 or the side view thereof.

Figure 2:
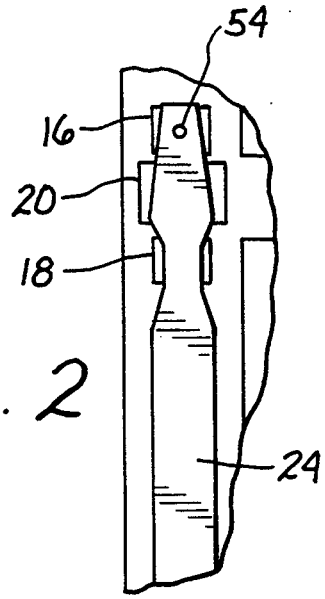
FIG. 2 shows a detailed view of a hammerspring of this invention as encircled through partial circle 2—2 of FIG. 1.

After the fret 40 is ground into the side elevation or thickness dimensions in the views of FIGS. 4, 5 and 6 the plan view or dimensions of width of the fret 40 and hammerspring 24 is shaped. This is provided by cutting the metal between the respective hammersprings 24 and shaping them in the plan view as seen in FIGS. 1 and 2. This is accomplished by an electrical discharge wire cutting process which is known in the art.

Fundamentally, an electrical discharge through a wire is utilized to cut the plan view of the frets 40 as shown in FIGS. 1 and 2 and shaping them in the manner as shown. The electrical discharge can be by a wire cutter which is known in the art discharging into deionized water or oil in order to provide for proper dielectric properties to prevent discharge through the whole media. This discharge specifically cuts the plan view or width dimension of the frets 40 and accompanying hammersprings 24 as shown in FIG. 1.

Each hammerspring 24 is then provided with its tungsten carbide printing tip or rod 54 which can be seen in the various figures. This tungsten carbide printing tip 54 is the tip which does the printing through the dot matrix process. These tungsten carbide tips are well known in the art in line printers and dot matrix printers and can be exemplified by numerous patents as owned by the Assignee of this invention.

The tungsten carbide printing tips 54 are welded to the hammersprings 24 by means of electric arc welding. The tungsten carbide tips are emplaced in an electric arc welding jig and held in juxtaposition to the hammersprings 24 under a given pressure. Electrical power is then conducted through the tungsten carbide tip 54 to the hammerspring 24 in the jig. The jig holds a series of hammersprings 24 in the form of the fret 40. This allows for the electric arc welding due to the flow of current through the cobalt of the tungsten carbide of the tip 54. Generally, the cobalt can be in the range of eight percent (8%) to twenty four percent (24%) and preferably in the range of sixteen percent (16%) for proper welding.

The cobalt of the tip fundamentally flows and welds the tungsten carbide printing tip 54 in a gusset or filet pattern and mushrooms out at the base to provide an expanded base of the printing tip 54 where it is welded to the hammerspring 24. This provides for a stronger weld and maintenance of the printing tip 54 in connection with the hammerspring 24 without the requirement of brazing or other complicated methods of attaching the printing tip 54 to the hammerspring 24.

In order to provide for an appropriate magnetic force function, a pair of magnetically conducting strips, conductors, or members 16 and 18 are mounted in the framework 12. These terminate and in part form the pole pieces 16 and 18 as the ends thereof. These magnetic conductors are formed initially of a highly magnetically conductive material that has been laminated from a number of sheets of magnetic material sandwiched with non magnetically conductive layers to limit any improper, spurious or eddy currents forming in their longitudinal direction.

Between the magnetically conductive elements or conductors 16 and 18 is a permanent magnet 66. The placement of the permanent magnet 66 allows conduction of magnetism through the magnetically conductive conductors 62 and 64 to provide for a magnetic force at the magnetic pole pieces 16 and 18 which are in effect the respective ends of the conductors.

The magnetic conductors 62 and 64 are molded or potted into a plastic material. The entire plastic material is then emplaced within the openings 15 of the framework 12 and solidified therein by potting or pouring a ceramic loaded potting compound. In this manner, the pole pieces 16 and 18 appear on the front surface as seen in FIG. 1 with the inconel or wear bar 20 therebetween while at the rear as shown in FIG. 3, the terminals 28 and 30 are exposed.

Terminals 28 and 30 are connected to coils 70 and 72. These coils 70 and 72 are energized by electrical current through terminals 28 and 30 to provide for overcoming the magnetic forces at the pole pieces 16 and 18. Thus, the magnetic force on the pole pieces 16 and 18 can be overcome by energization through electrical energy at the terminals 28 and 30 thereby overcoming any magnetic forces at pole pieces 16 and 18. This electrical energization can be delivered through various alternate means such as strips or conductors of various configurations to overcome the magnetism.

Looking more specifically at the hammerspring 24, it can be seen that when the hammerspring is attached by the screws 42 in a tightened manner with the frets in alignment against the hammerbank 10, that the hammersprings 24 are bent backwardly as seen in FIG. 5. This retention through the magnetic energy creates stress in the spring section of the hammerbank that will be detailed hereinafter to provide for the mechanical energy necessary to create the impact printing hereof.

When the permanent magnetism is overcome at the pole pieces 16 and 18 by the flow of current through the coils 70 and 72 or other conductors, the hammersprings 24 are released. This causes them to fire toward the right hand side as shown in FIG. 5. Retention and release movement is in the direction of double sided arrow F. The dotted configuration shown by the dotted outline 78 showing the movement of the hammerspring 24 shows the hammerspring 24 going over dead center. Generally, it is preferred that the hammerspring 24 only travel to an upright or mid center position rather than traveling beyond the mid center position. This allows for faster retraction and operational speeds.

One of the key features of this invention is the provision of stored mechanical energy in the hammerspring 24 as indicated in FIG. 5. This stored energy is the energy that is provided by converting the stored magnetic potential energy to stored mechanical energy. In effect, the permanent magnetism at pole pieces 16 and 18 provides the magnetic potential energy that pulls the hammerspring 24 to the left as seen in FIG. 5 to provide for the stored mechanical energy in its bent or stressed configuration. This stored mechanical energy is then released by the flow of current through coils 70 and 72.

When the hammersprings 24 are placed on the hammerbank 10, the ends of the hammersprings 24 form a lower reluctance path to the magnetic circuit at the ends of the pole pieces or tips 16 and 18. This increases the magnetic field through the circuit at the pole pieces 16 and 18 and results in stored magnetic energy in the two air gaps between the end of the hammerspring 24 and the two pole pieces 16 and 18. The force of the magnetics pulling the hammersprings 24 toward the pole pieces 16 and 18 is a force that is released through the discharge of current through the coils 70 and 72 in overcoming the permanent magnet's force.

The stored mechanical energy is in the form of strain energy along the hammerspring 24 wherever it is bent. The stored mechanical strain energy arises due to mechanical stress in the cross section of the hammerspring 24. In order to optimize the life of the hammerspring 24, maximum stress should be less than the fatigue strength of the magnetic steel used with the hammerspring 24.

The printing criteria is for the printing tip 54 to strike the paper that is to be printed upon with sufficient force and be retracted sufficiently quickly so as to provide for high cycle times. The particular printing in this instance is against an ink ribbon 80. The ink ribbon 80 as seen in FIG. 4 is under a plurality of apertures 82 oppositely spaced along the length of the hammerbank 10 thereof. The apertures 82 are disposed adjacent to the impact or printing tips 54 allowing them to extend therethrough for impacting the ink ribbon 80, including a hammerbank cover 83. A thin planar paper ironer 86 is shown. This is formed of a resilient material and is disposed against the paper 88 to create a drag and hold the paper under tension as it is advanced by the tractor drive of the printer. A ribbon mask 90 is shown to serve as a guide for the ink ribbon 80. This also prevents direct contact between the ink ribbon 80 and the paper 88 except in that area through which the dot printer impacts namely by printing tip 54.

The engineering parameters that must be controlled and balanced to create an effective printing device by the printing tip 54 printing against the paper 88 must be established based upon a particular printing gap. In this embodiment, the hammerspring 24 must move a minimum distance or about 0.012 plus or minus 0.003 inches because of paper thickness and compression set. This takes into account ribbon thickness and compression deflection and variations of paper thickness as well as machine alignment and other criteria that affects the orientation of the printing tips 54 in order for them to strike the paper properly.

The hammerspring 24 must have sufficient energy to print a certain darkness or density using the ink ribbon 80 as a variable ink source. The energy stored in the hammerspring 24 is used to determine the density of the printing as well as the frequency by the following equations.

$$E=\tfrac{1}{2}\,k\cdot Y\cdot Y$$

where k is the spring constant of the hammerspring 24 with normal deflection Y $$f=\tfrac{1}{2}\pi\sqrt{k/M}$$

M where M is the effective mass of the hammerspring 24—frequency in hertz

As the hammerspring is pulled down by the magnetic field it resists with a force $$F=k\cdot Y$$

This force leads to a bending moment at any distance x from the free end.

$$M=F\cdot x=k\cdot Y\cdot x$$

This bending moment leads to stress in the hammerspring 24

$$s=M\cdot z/I$$

where z is the distance from the neutral longitudinal axis to the surface of the hammerspring 24.

$$s=k\cdot Y\cdot x\cdot z/I$$

where I is the second moment of inertia of the hammerspring 24 with respect to the neutral axis.

The hammersprings 24 are uniform at any one transverse cross section so that the maximum distance of z=c in either direction from the neutral axis. Thus the maximum stress at any cross section is equal to $$s=kYxc/I$$

The maximum stress must be carefully controlled to less than 0.3 of the yield strength so that the hammerspring 24 will not fracture inasmuch as 10 million cycles can easily take place within 2 hours and the hammerspring 24 should not fail through fatigue fracture for thousands of hours.

The deflection of the spring from a neutral energy position must be in the neighborhood of 0.014+/−0.002 inches—which is the maximum stored energy position of the hammerspring 24. This then relates to the force required by the magnetic circuit to pull the hammerspring 24; the maximum allowable stress in the spring; and, the frequency response desired of the hammerspring 24.

The frequency of the hammerspring is proportional directly to the square root of the force constant. The force constant of the hammerspring 24 also determines the energy stored in the spring portion by $$E=\tfrac{1}{2}\cdot k\cdot Y\cdot Y$$

where k is the force constant and Y is the spring deflection from neutral.

Thus a high force constant for a desired maximum deflection Y produces a stress in the hammerspring 24 that is limited by the fatigue strength of the hammerspring 24 material.

The equation of the maximum stress versus force constant indicates that the stress is maximum at the fixed end by the equation $$Y\cdot k\cdot x\cdot c/I$$

where x=L, the distance from the applied force to the fixed end.

This results in an energy storage density that varies as the square of this distance given by $$Y \cdot 2 \cdot k \cdot 2 \cdot x \cdot 2/2 \cdot E \cdot I.$$

The frequency response goes up as the square root of the hammerspring 24 force constant and this force constant goes up as the total energy in the spring goes up. Therefore, in order to increase the frequency to produce faster printers one needs to increase the stored energy without causing fatigue fractures. This can be accomplished by having a uniform energy density.

Thus maximizing the frequency at a higher level is allowed if one designs the spring with a uniform energy density.

Thus the design of the spring must control this stress for any desired k and Y, and frequency parameters dictated by the overall printing characteristics. Thus the factor c/I must be controlled at any position x on the hammer so that xc/I is a constant and yields a stress level at some safety margin below 0.3 times the yield strength.

Thus at every point x from the free end of the hammerspring 24 the ratio of $$xc/I = s/kY$$

In order for this to occur c and/or I must be functions of x. Since we have chosen that there is no variation in the transverse sectional width at any transversal of the hammerspring 24 in the Y direction and since c and I are related in that c=d/2 and I=1/12 b d cubed then $$b \cdot d \cdot d = 6 \cdot k \cdot Y \cdot x/s \text{ or}$$

$$d = 2/6kYx/bs$$

An initial distance of x to the distance 'a' is thick. Thus, the stress need not be calculated in that it is very small due to the relative thickness needed for the effective mass of the hammerspring 24. Also it is required for a low reluctance magnetic path so that the force F is produced in this region by the magnetic circuit.

The width b and the thickness d are advantageously chosen to maximize the ratio between the primary and higher order modes of vibration. These modes of vibration will lead to unusual wear patterns that will shorten life and also create print energies less than desired. This can be accomplished by having b wider than the width it would have been if the stress was of no concern and it helps minimize the variation of d with x which would lead to a thin section at minimum x=a.

Thus in the energy storage section of the spring the maximum stress is held constant by varying the cross section by equation 1. The maximum energy density is also held constant because energy density is proportional to stress times strain and stress is proportional to strain times the material constant E or Young's modulus.

Basing the foregoing equations and design criteria into a format suitable for operational embodiments, the hammerspring 24 was formed in the manner as shown.

In particular, the hammerspring 24 has three particular areas of note. The first area is the base area 102 or lower portion of the fret 48. The second portion is the neck, or spring portion or neck 104 through which the deflection of the hammerspring 24 takes place. The third section is the magnetic retention, or end section or portion 106 that is designed in a manner to provide for a proper magnetic flow path and maintenance and provision of the printing tip 54 with sufficient mass.

Figure 9:
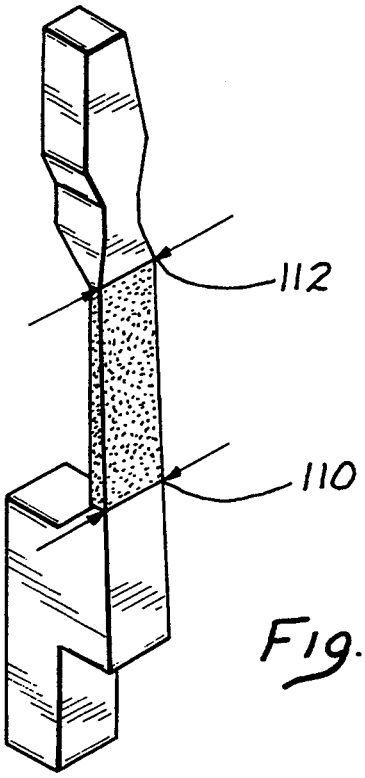
FIG. 9 shows a view of the hammerspring of this invention illustrating the uniform stress along the neck or spring portion thereof.
Figure 10:
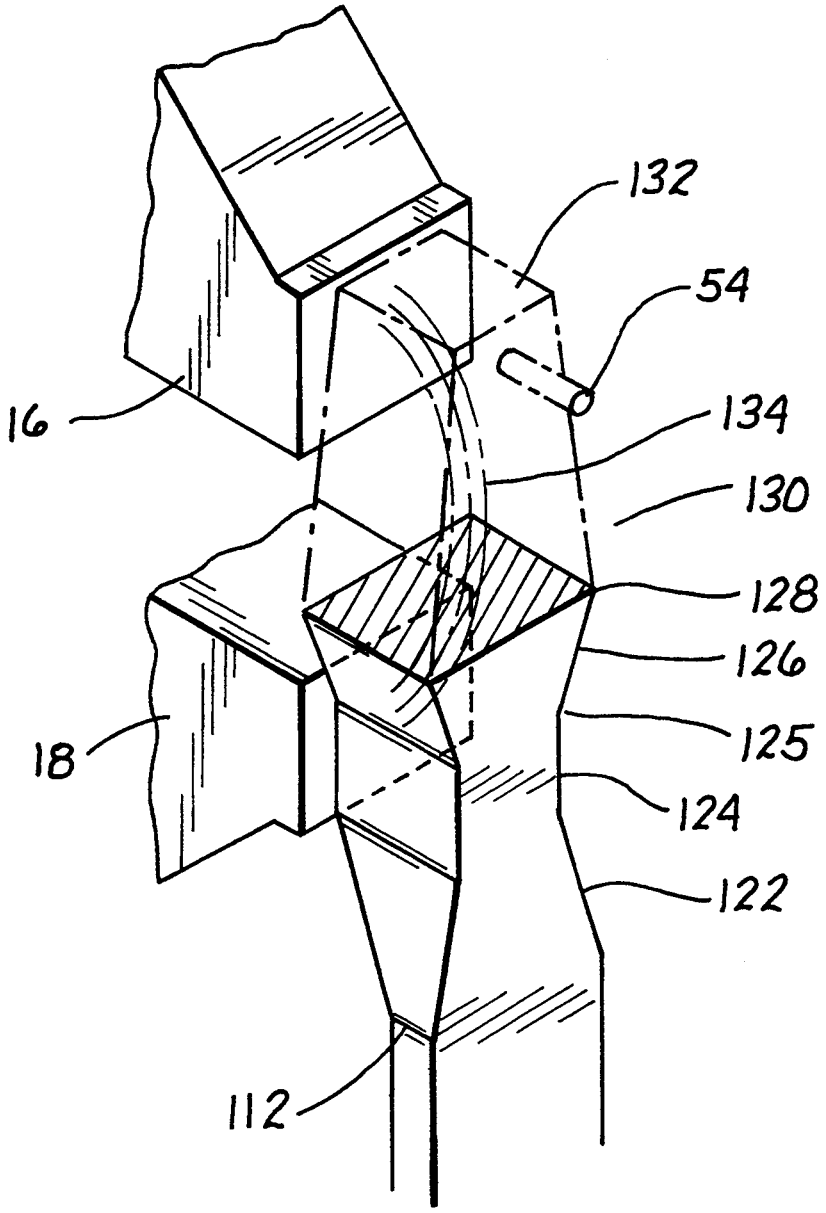
FIG. 10 shows a perspective and sectional view of the hammerspring of this invention in contact with the pole pieces with the magnetic lines of flux flowing through the low reluctance path provided by the hammerspring.

In order to provide for a strong and suitable base portion of the fret 48, the fret portion is made of a material approximately 5.8 times the thickness of the spring material 104. The spring or neck portion 104 is formed in a manner so that it decreases in thickness or cross sectional dimensions from its initial point or line of flexure 110 to the end of its point or line of flexure 112. This diminishing of the thickness is from approximately 0.024 inches to 0.019 inches. This allows for a uniform stress to be maintained when it is bent along the distance between points 110 and 112. In order to show the uniform stress under a bending movement, a stress characterization has been shown in FIG. 9. The stress from points or lines 110 to 112 can be seen as uniformly extending between points 110 and 112 by the cross hatching indicating uniform stress.

The shape of the spring region tapers from points or lines 110 and 112. Under the deflection conditions in which the stress is built up, it provides for uniform stress. This uniform stress allows for the functioning of the hammerspring 24 to eliminate stress points that would create fracturing or later defects in the overall operation. Also, it provides for uniform energy density so that the stress due to the energy density is uniform, thereby providing optimum response.

The energy density and design provided by the stress through the spring portion or neck 110 and 112 of the particular steel being used is below thirty percent (30%) of its yield strength. Thus, for steel of this type, the number of cycles in order to break the hammerspring 24 far exceeds the yield strength as plotted against a number of cycles for which the steel of this particular type is approximately ten to the ninth power $10^9$. The preferred steel that has been selected is a 9310 steel because of its fairly good magnetic properties (i.e. 21 KG saturation) and good mechanical properties of (180 Kpsi) tensile strength.

Based upon this, the cycle times are 425 micro seconds or better. Also, the peak stress to provide substantially greater longevity is below 48,000 psi. The ratio between the second and first transverse mode of frequency is higher than 9.0. Furthermore, the spring has a uniform energy storage or uniform stress level to achieve the optimum dynamic response as shown in the criteria of the stress uniformity of FIG. 9 between points or lines 110 and 112. This allows the uniform stress level of the hammerspring 24 by gradual reduction along the length of the spring to create the criteria of the improved hammerspring hereof.

The thickness of the neck or spring portion 104 as shown in FIG. 6 has been decreased by 0.005 between dimensional lines 110 and 112. This provides a thickness or sectional dimension of 0.024 inches at dimension line 110, and 0.019 inches at dimension line 112. The plan view or width, is decreased by 0.010 inches between dimensional lines 110 and 112. Although this is not readily apparent from the figures, it can be seen in FIG. 9 that the measurement of the hammerspring 24 across the width of the plan view at line 110 to the width across the plan view at line 112 has been decreased by 0.010 inches to provide for changes in the width dimensions of 0.080 at line 110 and 0.070 at line 112.

This provides for a peak in uniform stress of 44,000 psi. Also, the ratio between the transverse modes is 9.8. This is particularly an improvement over the transverse mode of standard leaf type or flat hammersprings of the prior art of 6.8. The cycle time that is achieved on this particular spring is 360 micro seconds. The totality of the foregoing provides for a platen gap margin of from six to eight mils.

Another consideration or criteria of design and importance in order to provide for the foregoing resides within the end of the hammerspring 120. The end 120 is formed with an enlarged portion or bulbous mass and constitutes what could be referred to as a magnetic flux conducting or coupling area or region of mass. This provides for a maximum allowable mass so that the magnetic force that is specified for the pole pieces or ends 16 and 18 can be optimized. In order to provide for this, the end of the hammerspring 24 namely end 120 initiates from a necked down portion 122 from the neck 104 starting from line 112. Thus from the end of the spring portion 104 at the line of flexure 112 the plan view or width of the end portion necks down while at the same time expanding in its side or cross sectional view. This plan view or width necked down portion and expanded sectional or side portion 122 initiating from the line 112, terminates in a relatively thin rectangularly cross sectional joindure portion 124. The joindure portion 124 ends in an expansion outwardly from an expansion line 125 into an outer taper 126. The outer taper 126 expands outwardly to a maximum distance or thickness along line 128. This maximum distance or thickness 128 is spaced between the pole pieces 16 and 18 for the proper flow of magnetic forces and coupling. The exact placement between the pole pieces 16 and 18 is dependent upon the mass of the end portion and mechanical energy storage in the spring portion 104. Nevertheless it rests against wear bar 20 before being released. After release the hammerspring 24 end portion 124 returns to the magnetically held position and impacts the wear bar 20, thereby avoiding impacting the ends of the pole pieces 16 and 18 which are generally of a softer metal than the wear bar 20.

The maximum cross sectional portion 128 with the maximum width, then tapers inwardly into a tapered down portion 130 which terminates at the end 132 to provide for the mounting of the printing tip 54.

The magnetic coupling criteria is enhanced by having the enlarged portion through the widest point 128. In this manner the magnetic lines of flux between pole pieces 16 and 18 are maximized due to the widest and easiest point of travel of the magnetic lines of flux between the pole pieces 16 and 18. These lines of flux 134 are shown flowing between the pole pieces 16 and 18. Due to the lower resistance at the widest point 128 improved magnetic coupling is enhanced as to the magnetic flow between the pole pieces 16 and 18.

The configuration to provide substantial mass at the magnetic or end region 120 and at the same time optimum flow of the magnetic lines of flux creates the improved and enhanced maintenance of the hammerspring in its retained position as shown in FIGS. 4 and 5 until it is ready to be released.

As can be seen from the foregoing specification, the concomitant of the entire criteria is such where energy storage is maximized for any particular fatigue strain of the particular metal that is being used. Thus, the following claims should be read broadly in light of the improved magnetic flow path and the improved stress and energy relationships for the hammersprings.

We claim:

1. The improvement in a hammerspring for a dot matrix printer having a plurality of such hammersprings spaced along a hammerbank wherein said hammerbank has permanent magnetic means which draw said hammerspring into a retracted and mechanically stressed mode, and which can then be released by overcoming the permanent magnetic means through an electrical means wherein the improvement comprises:

a base portion of said hammerspring adapted to be connected to said hammerbank;

a spring portion having a thickness and a width extending from said base portion;

an enlarged end portion having a thickness and a width, said end portion uniformly increasing in thickness from said spring portion of said hammerspring to a set thickness for magnetic retention by said permanent magnet means of said hammerbank; said base, spring and enlarged end portion all being formed from a single coextensive piece of metal; and, said spring portion uniformly and continuously decreasing one of said thickness and width from said base portion to said end portion.

2. The improved hammerspring as claimed in claim 1 wherein:

said spring portion cross section decreases in thickness; and, said spring portion decreases in width from said base portion to said end portion.

3. The improved hammerspring as claimed in claim 1 wherein:

said base portion is interconnected to the base portion of a second hammerspring.

4. The improved hammerspring as claimed in claim 3 wherein:

said base portion interconnected to a second base portion of an adjacent hammerspring comprises a fret of a plurality of hammersprings wherein the base portions are interconnected to each hammerspring and attached to the hammerbank.

5. The improved hammerspring as claimed in claim 1 wherein:

said end portion has an expanded cross section which can be placed in proximity to said permanent magnetic means for improved flow of magnetic flux.

6. The improved hammerspring as claimed in claim 5 wherein:

said expanded cross section of said end portion when magnetically retained is placed within the region between two pole pieces comprising said permanent magnetic means.

7. The improved hammerspring as claimed in claim 5 wherein:

said spring portion is formed with a constantly decreasing cross section to provide uniform stress during magnetic retention through the spring portion by the respective magnetic means retaining said hammerspring to enhance mechanical energy being stored in said spring portion on a uniform basis.

8. A hammerbank for a dot matrix printer comprising:

a hammerbank frame;

a plurality of magnetic means disposed within said hammerbank frame;

a plurality of hammersprings adapted to be retained respectively by each magnetic means in a mechanically retracted manner by said magnetic means, each hammerspring having a base portion, a spring portion, and an end portion that can be magnetically retained proximate said magnetic means said spring portion having a thickness and a width, said base, spring and enlarged end portion all being formed from a single coextensive piece of metal, said spring portion uniformly and continuously decreasing in thickness and width between the base portion and the end portion; said end portion having a thickness and width, said end portion uniformly increasing in thickness from said spring portion to a set thickness; and, means for attaching said base portions to said hammerbank.

9. The hammerbank as claimed in claim 8 further comprising:

hammersprings having an end portion with a thickness and mass greater than said spring portion through its cross section area of greatest thickness.

10. The hammerbank as claimed in claim 8 wherein:

said hammersprings are disposed at said base portion in interconnected relationship to adjacent hammersprings for attachment in plural relationship to the hammerbank.

11. The hammerbank as claimed in claim 10 wherein:

said magnetic means comprises pairs of magnetic pole pieces; and, said hammerspring has an enlarged cross sectional area larger than the other portions of said end portion adapted to be disposed between said magnetic pole pieces providing a path of enhanced magnetic flux.

12. The hammerbank as claimed in claim 11 wherein:

said pole pieces are separated by a magnetic insulator extending beyond said pole pieces and against which said hammersprings are retained.

13. The hammerbank as claimed in claim 11 wherein:

said pole pieces are formed at the ends of laminated conductive strips extending from a permanent magnet for a magnetic flow path from said magnet; and, each of said pole pieces has an electrical conductor in proximate relationship which reduces the permanent magnetism to release said hammersprings.

14. The hammerbank as claimed in claim 8 wherein:

said spring portion uniformly decreases in width from said base portion to said end portion.

15. The hammerbank as claimed in claim 8 wherein:

said hammerspring comprises a spring portion that is uniformly stressed when placed into magnetic retention against said magnetic means of said hammerbank.

16. The combination of a hammerbank with hammersprings for printing on a dot matrix printer wherein the improvement comprises:

a hammerbank frame having a plurality of pairs of pole pieces in magnetically conductive relationship to a permanent magnet;

an electrically conductive member disposed in proximate relationship to each of said hammerbank pole pieces;

terminal means for connecting said electrically conductive members;

means for energizing said electrically conductive members to negate the permanent magnetism of said pole pieces;

a plurality of hammersprings, each disposed having an end portion spanning in proximate relationship each pair of said pole pieces, said hammersprings having a base portion, a spring portion, and an end portion all formed of a coextensive piece of metal said spring portion having a thickness and a width and uniformly and continuously tapers in decreasing thickness and width from said base portion; and said end portion having a thickness and width, said end portion uniformly increasing in thickness from said spring portion to a set thickness.

17. The combination as claimed in claim 16 wherein:

said spring portion is reduced uniformly in cross section placing it in uniform stress when in retracted magnetic relationship proximate said pole pieces.

18. The combination as claimed in claim 16 wherein:

said end portion has a cross sectionally enlarged portion spaced between said pole pieces.

19. The combination as claimed in claim 16 wherein:

said hammersprings are formed on said base portions in interconnected relationship as a series of hammersprings forming a fret.

20. A process for providing improved printing comprising:

providing a hammerbank frame;

supporting a plurality of permanent magnets in said hammerbank frame each having pairs of pole pieces;

means for negating the magnetism of said permanent magnets;

providing a plurality of hammersprings that can be retracted at the ends thereof across said pole pieces having a spring portion, enlarged end portion and printing tips;

retaining said hammersprings in a stressed condition uniformly through said spring portion across said pole pieces by said permanent magnets;

storing mechanical energy within said spring portion, said stressed condition of said hammersprings being provided through said spring portion having a uniformly and continuously decreasing thickness and width from where said hammerspring is mounted to said enlarged end portion, said end portion having a thickness and width, said end portion uniformly increasing in thickness from said spring portion to a set thickness; and releasing said hammersprings to allow for the stored mechanical energy of said spring portion to drive said printing tips against a print ribbon for purposes of printing a dot against an underlying piece of paper.

21. The process as claimed in claim 20 further comprising:

retracting said hammersprings against a surface extending beyond the ends of said pole pieces.

22. The process as claimed in claim 20 further comprising:

providing for the increased flow of magnetic flux through said end portion of said hammerspring by increasing the cross sectional dimensions of said hammerspring between said pole pieces.

23. The process as claimed in claim 22 further comprising:

retaining said hammersprings at the base portion thereof on a base member connected to adjacent base portions of hammersprings, all comprising a fret of hammersprings and base members.

24. The process as claimed in claim 20 wherein:

said uniform stress of said hammersprings is provided through a spring portion having a uniformly decreasing thickness from where said hammerspring is mounted to an enlarged end portion.

* * * * *